United States Patent [19]

James

[11] 4,102,156

[45] Jul. 25, 1978

[54] AGITATOR FOR WASHING MACHINES

[76] Inventor: Wallace D. James, 5946 Barbados Way E., West Palm Beach, Fla. 33407

[21] Appl. No.: 764,414

[22] Filed: Jan. 31, 1977

[51] Int. Cl.[2] ..... D06F 13/02

[52] U.S. Cl. ..... 68/4; 68/134

[58] Field of Search ..... 68/4, 13 R, 134; 134/115 R, 149, 152, 170; 416/62, 146; 415/DIG. 3

[56] References Cited

U.S. PATENT DOCUMENTS

| | | | |
|---|---|---|---|
| 1,805,107 | 5/1931 | Rocke | 68/134 |
| 2,763,147 | 9/1956 | Thiele | 68/134 |
| 2,976,711 | 3/1961 | Smith | 68/134 X |
| 3,922,890 | 12/1975 | Shibata | 68/4 X |

*Primary Examiner*—Philip R. Coe

[57] ABSTRACT

An agitator for domestic washing machines of conventional design is modified to provide tapped apertures to threadedly engage elongated rods, which are adapted to receive the core of circular filters; and, threaded closures are provided to close the tapped apertures for clothes washing; and, an adapter to convert the agitator of clothes washing agitator type machines to wash elongated circular filters.

4 Claims, 3 Drawing Figures

AGITATOR FOR WASHING MACHINES

BACKGROUND OF THE INVENTION

This invention relates to agitators for washing machines, and more particularly to a modified agitator for use in washing elongated water filters.

Elongated cylindrical filters for swimming pools and the like are expensive, and no satisfactory method of washing them for reuse has previously been devised. The invention provides a convenient, inexpensive and highly successful means of washing such filters by modification of the agitator of agitator type clothes washing machines.

BRIEF DESCRIPTION OF DRAWINGS

The invention will be more fully understood from the following specification, taken in conjunction with the drawings, forming a part thereof, wherein.

DESCRIPTION OF PREFERRED EMBODIMENTS

Figure 1:
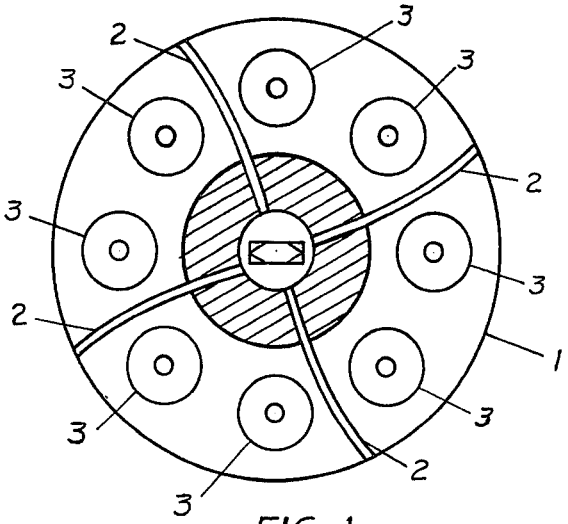
FIG. 1 is a plan view of an agitator of this invention with elongated cylindrical pool water filters positioned on the agitator.
Figure 2:
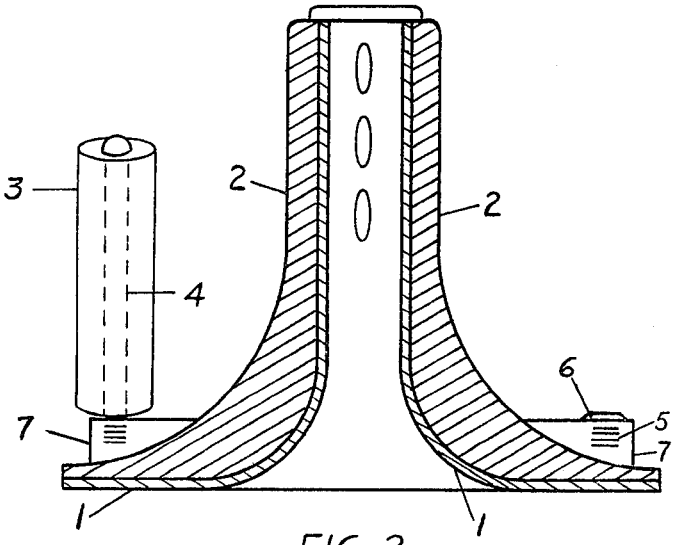
FIG. 2 is a longitudinal cross-sectional view of an agitator adapted to receive elongated cylindrical pool water filters for washing, with a tapped aperture closure member shown in one of the tapped apertures; and, FIG. 3 is a vertical cross-sectional view of a standard clothes washer agitator with tapped apertures for converting to cylindrical filter washing.
Figure 3:
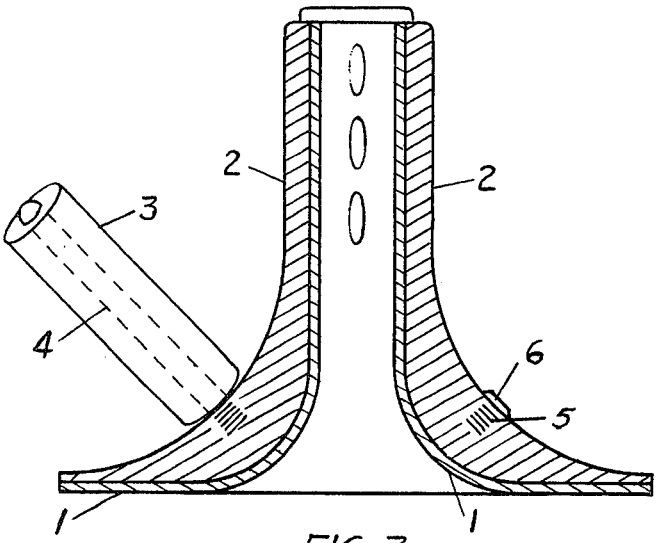

Referring to the drawings, wherein like members are given the same reference numeral, an agitator 1 of a conventional design clothes washer has a central, elongated, vertical shaft portion of substantially circular cross-section which tapers outwardly at its bottom portion to form a radially outwardly extending agitator flange portion. The agitator 1 also has longitudinal, arcuate vanes 2 which extend substantially radially outwardly from the shaft portion in conventional manner, the agitator being adapted to wash cylindrical filters 3 such as those employed in the filter system of swimming pools. The hollow core of the filter 3 is positioned over an elongated rod 4 having a threaded end portion engaging tapped apertures 5 in a wedge shaped flange portion 7 carried by the shaft portion 1 of the agitator.

The wedge shaped flange portion 7 may be cast integral with the agitator 1, or be provided in sections to be secured intermediate the vanes 2 of the agitator 1, to provide a substantially horizontal surface in which are located vertically oriented tapped apertures 5.

A round headed, threaded bolt 6 which conventional small indentations for removing with a suitable implement, is provided to close the threaded aperture 5, to provide the agitator with smooth surfaces for clothes washing purposes.

The conventional agitator may be modified by tapping aperture 5 in the lower flange portion of the agitator to receive the threaded end of the rod 4 on which the cylindrical filter 3 is positioned. However, due to the proximity of the wall of the washer tub to the agitator in most washing machines, some of the longer cylindrical filters could not be washed because there is insufficient clearance for the longer cylindrical filters, hence the preferred embodiment is as shown in FIG. 1.

What is claimed is:

1. An agitator for an agitator type washing machine for selectively washing clothes and washing cylindrical filters, said agitator including:

an elongated shaft portion of substantially circular cross-section, said shaft portion tapering radially outwardly at its bottom portion to form an outwardly extending agitator flange portion;

a plurality of longitudinal, arcuate vanes extending substantially radially outwardly from said shaft portion;

at least one wedge-shaped flange carried by said shaft portion on the upper surface of said agitator and providing a substantially horizontal surface on said agitator;

at least one tapped aperture formed in the upper surface of said wedge-shaped flange; and at least one threaded, elongated rod removably threadedly engaging said aperture and extending substantially vertically upwardly from said wedge-shaped flange when engaged in said aperture, said rod securing cylindrical filters to said agitator for washing said filters.

2. The agitator of claim 1, further including at least one round-headed bolt removably threadedly engaging said aperture in the absence of said rod.

3. The agitator of claim 1, wherein said wedge-shaped flange is integral with said agitator.

4. The agitator of claim 1, wherein said wedge-shaped flange is formed in a plurality of sections, each said section being secured between adjacent vanes.

* * * * *